US006987261B2

(12) United States Patent
Horning et al.

(10) Patent No.: US 6,987,261 B2
(45) Date of Patent: Jan. 17, 2006

(54) CONTROLLING ION POPULATIONS IN A MASS ANALYZER

(75) Inventors: Stevan Horning, Deimenhorst (DE); Robert Malek, Lilienthal (DE); John E. P. Syka, Charlottesville, VA (US); Andreas Wieghaus, Bremen (DE)

(73) Assignee: Thermo Finnigan LLC, San Jose, CA (US)

( * ) Notice: Subject to any disclaimer, the term of this patent is extended or adjusted under 35 U.S.C. 154(b) by 1 day.

(21) Appl. No.: 10/763,401

(22) Filed: Jan. 23, 2004

(65) Prior Publication Data

US 2004/0217272 A1 Nov. 4, 2004

Related U.S. Application Data

(60) Provisional application No. 60/476,473, filed on Jun. 5, 2003, provisional application No. 60/442,368, filed on Jan. 24, 2003.

(51) Int. Cl.
*H01J 49/00* (2006.01)

(52) U.S. Cl. ..... 250/282; 250/286; 250/288; 250/290

(58) Field of Classification Search ..... 250/282, 250/286, 288, 290; 436/173
See application file for complete search history.

(56) References Cited

U.S. PATENT DOCUMENTS 5,179,278 A 1/1993 Douglas
5,572,022 A 11/1996 Schwartz et al.
5,739,530 A 4/1998 Franzen et al.
6,331,702 B1 12/2001 Krutchinsky et al.
2004/0245455 A1 * 12/2004 Reinhold ..... 250/288

FOREIGN PATENT DOCUMENTS

GB 2353632 A 2/2001

OTHER PUBLICATIONS

A. N. Krutchinsky, et al., "Collisional Damping Interface for an Electrospray Ionization Time-of-Flight Mass Spectrometer", *J. American Society for Mass Spectrometry*, 9:569-579 (1998).
Jean H. Futrell, "Development of tandem mass spectrometry: one perspective," *International Journal of Mass Spectrometry*, 200:495-508 (2000).

* cited by examiner

*Primary Examiner*—Nikita Wells
*Assistant Examiner*—Zia R. Hashmi
(74) *Attorney, Agent, or Firm*—Fish & Richardson P.C.; Sharon Upham

(57) ABSTRACT

Method and apparatus of controlling an ion population to be analyzed in a mass analyzer. Ions are accumulated for an injection time interval determined as a function of an ion accumulation rate and a predetermined desired population of ions. The accumulation rate represents a flow rate of ions from a source of ions into an ion accumulator. Ions derived from the accumulated ions are introduced into the mass analyzer for analysis.

79 Claims, 9 Drawing Sheets

Instrument Computer Controller 145
Ion Detector
Ions
125
610
Ion Source 115
+
-
-
+
600
Linear Trap 120

CONTROLLING ION POPULATIONS IN A MASS ANALYZER

CROSS-REFERENCE TO RELATED APPLICATIONS

This application claims the benefit of U.S. Provisional Application No. 60/442,368, filed on Jan. 24, 2003, and U.S. Provisional Application No. 60/476,473, filed on Jun. 5, 2003, both of which are incorporated by reference herein.

BACKGROUND

The invention relates to controlling the ion population in a mass analyzer.

Ion storage type mass analyzers, such as RF quadrupole ion trap, ICR (Ion Cyclotron Resonance), orbitrap, and FTICR (Fourier Transform Ion Cyclotron Resonance) mass analyzers, function by transferring generated ions via an ion optical means to the storage/trapping cells on the mass analyzer, where the ions are then analyzed. One of the major factors that limit the mass resolution, mass accuracy and the reproducibility in such devices is space charge, which can alter the storage, trapping conditions, or ability to mass analyze of an ICR or ion trap, from one experiment to the next, and consequently vary the results attained.

Similarly, in operation of a Time of Flight (TOF) system, or a hybrid TOF mass spectrometer, such as a Trap-TOF, the operator typically attempts to deliver as high an absolute ion rate as possible to the TOF to maximize sensitivity, but not so high as to saturate the detection system. When dealing with internal mass standards for high mass accuracy measurements, this problem is further compounded by the need to match closely the relative intensities of the internal standard and the analytes of interest.

Space charge effects arise from the influence of the electric fields of trapped ions upon each other. The combined or bulk charge of the final population of ions causes shifts in frequency and therefore m/z. At very high levels of space charge, the obtainable resolution will deteriorate and peaks close in frequency (m/z) can at least partially coalesce. A significant scan to scan variation in the magnitude of the space charge effect arises from differences in trapped ion density, caused by changes in the number of ions within the cell from one ionization/ion injection event to the next. Unless space charge is either taken into account or regulated, high mass accuracy, precision mass and intensity measurements can not be reliably achieved.

In a uniform magnetic field and in the absence of any other forces on the ion, the angular frequency of motion of an ion is a simple function of the ion charge, the ion mass, and the magnetic field strength:

$$\omega = qB/m$$

where ω=angular frequency, q=ion charge, B=magnetic field strength, and m=ion mass. This simplified equation ignores the effects of electric fields on the frequency of the ion. As described by Francl et al., "Experimental Determination of the Effects of Space Charge on Ion Cyclotron Resonance Frequencies" Int. J. Mass Spectrom. Ion Processes, 54, 1983 p. 189–199, which is incorporated by reference herein, the cyclotron frequency of the ion in an ICR cell can be approximately described by:

$$\omega = qB/m - 2\alpha V/a^2B - q\rho G_i/\epsilon_0 B$$

where α is a cell geometry constant, V is the trapping voltage, a is the cell diameter, ρ is the ion density, $G_i$ is an ion cloud geometry constant, and $\epsilon_0$ is the permittivity of free space.

Hence, if the ion population in a FTICR is allowed to vary, the measured peak positions will move as a result of the interaction of the ions with the electrostatic fields of the other ions in addition to the fields of the cell and magnet. This has been a relatively minor problem, resulting in mass shifts of a few 10's of ppm. However, as analytical requirements have progressed, it now has become desirable to obtain mass accuracies in the single ppm range.

One way to improve the reproducibility of results, the mass resolution and accuracy in ion storage type devices is to control the ion population that is stored/trapped, and subsequently analyzed in the mass analyzer.

SUMMARY

The present invention provides methods and apparatus for controlling ion population in a mass analyzer by accumulating a predetermined population of ions and forwarding the accumulated population of ions to the analysis cell or portion of a mass analyzer.

In general, in one aspect, the invention provides methods and apparatus implementing techniques for controlling an ion population to be analyzed in a mass analyzer. The techniques include determining an accumulation period representing a time required to accumulate a specified predetermined population of ions; accumulating ions for an injection time interval corresponding to the accumulation period; and introducing the accumulated ions into the mass analyzer.

In general, in another aspect, the invention provides methods and apparatus implementing techniques for operating a mass analyzer. The techniques include controlling a population of ions to be introduced into the mass analyzer by accumulating ions and introducing ions derived from the accumulated ions into the mass analyzer. The ions are accumulated for a time period determined as a function of an ion accumulation rate and a predetermined optimum population of ions. The accumulation rate represents a flow rate of ions from a source of ions into an ion accumulator.

In general, in a third aspect, the invention provides methods and apparatus implementing related techniques for operating a mass analyzer. The techniques include introducing a first sample of ions from a source of ions into a multiple multipole device; accumulating ions derived from the first sample of ions in an ion accumulator during a sampling time interval; detecting ions derived from the first sample of ions; determining an injection time interval based on the detecting and the sampling time interval; introducing a second sample of ions from the source of ions into the multiple multipole device; accumulating ions derived from the second sample of ions in the ion accumulator for a time corresponding to the injection time interval; and introducing ions derived from the accumulated ions into the mass analyzer. The injection time interval represents a time interval for obtaining a predetermined optimum population of ions.

In general, in still another aspect, the invention provides methods and apparatus for operating a mass analyzer. The techniques include performing a pre-experiment in which a sample of ions is introduced along an ion path extending from a source of ions to the mass analyzer and ions derived from the sample of ions are accumulated during a sampling time interval. Ions derived from the sample of ions are detected, and an injection time interval is determined based on the detecting and the sampling time interval. Ions are accumulated for a time corresponding to the injection time interval, and ions derived from the accumulated ions are introduced into the mass analyzer. The injection time interval represents a time interval for obtaining a predetermined optimum population of ions.

Particular implementations can include one or more of the following features. The ions can be accumulated in an ion accumulator. The techniques can include transferring the accumulated ions from the ion accumulator to a storage device before introducing ions into the mass analyzer. Accumulating ions for a time corresponding to the injection time interval can include accumulating ions during two or more time periods. Transferring the accumulated ions from the ion accumulator to a storage device can include transferring the accumulated ions from the ion accumulator to the storage device after each of the two or more time periods before introducing ions into the mass analyzer. The techniques can include a second pre-experiment in which a number of time periods is determined during which ions will be accumulated in step. Ions can be accumulated and transferred to the storage device according to the determined number of times before the total accumulated population of ions is introduced into the mass analyzer.

The ion accumulator can include an RF ion storage device, such as a ring ion guide, a 3D trap, a multipole ion guide or other suitable device. The multipole ion guide can be a RF multipole linear ion trap. Detecting ions derived from the sample of ions can include ejecting at least a portion of the ions derived from the sample of ions from the ion accumulator to a detector in a direction transverse to an ion path from the ion accumulator to the mass analyzer. The multipole ion guide can be an RF quadrupole ion trap.

The ions can be filtered with a mass filter before being accumulated. Filtering the ions can include passing the sample of ions and the ions through a multipole device including one or more mass filters. The mass filter can include a quadrupole device. The ions can be detected in the detector after being accumulated in the ion accumulator. Substantially all ions derived from the sample of ions can be removed from the ion accumulator before any subsequent accumulation of ions.

Accumulating ions can include receiving ions in the ion accumulator substantially continuously during a single time interval. The ion accumulator may also be a mass spectrometer.

Detecting ions derived from the sample of ions can include detecting the charge density or ion density of the ions derived from the sample of ions. Detecting ions derived from the sample of ions can include detecting ions in the sample of ions. Introducing ions derived from the accumulated ions into the mass analyzer can include introducing at least a portion of the accumulated ions into the mass analyzer.

Product ions can be generated from the accumulated ions, and introducing ions derived from the accumulated ions can include introducing at least a portion of the product ions into the mass analyzer. Product ions can be generated from ions in the sample of ions and from the ions to be mass analyzed. Detecting ions derived from the sample of ions can include detecting at least a portion of the product ions generated from ions in the sample of ions. Introducing ions derived from the accumulated ions into the mass analyzer can include introducing into the mass analyzer at least a portion of the product ions generated from the accumulated ions.

The mass analyzer can be an RF quadrupole ion trap mass spectrometer, a ion cyclotron resonance mass spectrometer, an orbitrap mass spectrometer, or a TOF device. The source of ions can produce a substantially continuous stream of ions. The source of ions can be an atmospheric pressure chemical ionization (APCI) source, an atmospheric pressure photo-ionization (APPI) source, an atmospheric pressure photo-chemical-ionization (APPCI) source, a matrix assisted laser desorption ionization (MALDI) source, an atmospheric pressure MALDI(AP-MALDI) source, an electron impact ionization (EI) source, an electrospray ionization (ESI) source, an electron capture ionization source, a fast atom bombardment source or a secondary ions (SIMS) source.

A mass spectrum of the ions derived from the accumulated ions can be determined. The mass spectrum can be determined by scaling intensities of peaks in the mass spectrum according to the injection time interval.

In some implementations, the accumulation rate can measured while the ions are being accumulated. For example, the accumulation rate can be measured by diverting a portion of an ion beam to a detector while the ions are being accumulated. A portion of the ion beam can be transmitted to an ion accumulator, while a signal representative of a remaining portion of the ion beam can be detected while the ions are being accumulated.

In general, in another aspect, the invention provides a mass analyzing apparatus. The apparatus includes a source of ions; a mass analyzer located downstream of the source of ions along an ion path; an ion accumulator located between the source of ions and the mass analyzer along the ion path; a detector located to receive ions from the source of ions and configured to generate signals indicative of detecting the received ions; and a programmable processor in communication with the detector and the ion accumulator. The programmable processor is operable to use the detector signals to determine an accumulation period representing a time required to accumulate in the ion accumulator a specified population of ions; cause the ion accumulator to accumulate ions for an injection time interval corresponding to the accumulation period; and introduce ions derived from the accumulated ions into the mass analyzer.

Particular implementations can include one or more of the following features. The ion accumulator can be included in a second mass analyzer. The apparatus can include a mass filter located between the source of ions and the ion accumulator along the ion path. The mass filter can be included in a multiple multipole device located downstream of the source of ions along the ion path. The multiple multipole device can include a mass filter and a collision cell.

The detector can be located outside of the ion path. The ion accumulator can be configurable to eject ions linearly along the ion path towards the analyzing mass analyzer or towards the detector in a direction transverse to the ion path. A diversion unit can be located downstream of the multiple multipole device along the ion path. The diversion unit can be configurable to divert ions from the ion path towards the detector. The detector can be located along the ion path. The detector can include a conversion dynode located downstream of the multiple multipole device along the ion path.

The apparatus can include a storage device located downstream of the ion accumulator along the ion path. The storage device can be configurable to iteratively receive and accumulate ion samples from the ion accumulator and to eject the accumulated ion samples towards the mass analyzer.

The mass analyzer can be an RF quadrupole ion trap mass spectrometer, a ion cyclotron resonance mass spectrometer, or an orbitrap mass spectrometer. The source of ions can be an atmospheric pressure chemical ionization (APCI) source, an atmospheric pressure photo-ionization (APPI) source, an atmospheric pressure photo-chemical-ionization (APPCI) source, a matrix assisted laser desorption ionization (MALDI) source, an atmospheric pressure MALDI(AP-MALDI) source, an electron impact (EI) source, an electro-spray ionization (ESI) source, an electron capture ionization source, a fast atom bombardment source or a secondary ions (SIMS) source.

In general, in another aspect, the invention provides a mass analyzing apparatus that includes a source of ions; an ion cyclotron resonance (ICR) mass spectrometer located downstream of the source of ions along an ion path; a detector located off of the ion path; an RF linear quadrupole ion trap located between the source of ions and the ICR mass spectrometer along the ion path; and a programmable processor in communication with the detector and the linear ion trap. The RF linear quadrupole ion trap is configured to receive ions from the source of ions along the ion path and is configurable to eject ions linearly along the ion path towards the ICR mass spectrometer or towards the detector in a direction transverse to the ion path. The processor is operable to determine an accumulation period representing a time required to accumulate in the RF linear quadrupole ion trap a specified population of ions; cause the RF linear quadrupole ion trap to accumulate ions for an injection, time interval corresponding to the accumulation period; and introduce at least a portion of the accumulated ions into the ICR mass spectrometer.

Particular implementations can include one or more of the following features. A multipole mass filter and a collision cell can be located between the source of ions and the linear ion trap along the ion path. A storage device can be located downstream of the linear ion trap along the ion path. The storage device can be configurable to iteratively receive and accumulate ion samples from the linear ion trap and to eject the accumulated ion samples towards the ICR mass spectrometer.

The invention can be implemented to provide one or more of the following advantages. The population of ions accumulated in the ion accumulator and the population of ions introduced into the mass analyzer can be controlled to reduce or eliminate space charge effects in the selection and analysis of ions. In $MS^n$ experiments, both the population of precursor ions and/or the population of product ions can be controlled. Unwanted ions can be removed from the ion stream before ions are introduced into the mass analyzer, resulting in improved sensitivity, accuracy, resolution and speed of the measurement achieved by the mass analyzer.

Unless otherwise defined, all technical and scientific terms used herein have the meaning commonly understood by one of ordinary skill in the art to which this invention belongs. In case of conflict, the present specification, including definitions, will control. Unless otherwise noted, the terms "include", "includes" and "including", and "comprise", "comprises" and "comprising" are used in an open-ended sense—that is, to indicate that the "included" or "comprised" subject matter is or can be a part or component of a larger aggregate or group, without excluding the presence of other parts or components of the aggregate or group. The details of one or more implementations of the invention are set forth in the accompanying drawings and the description below. Further features, aspects, and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

Figure 1:
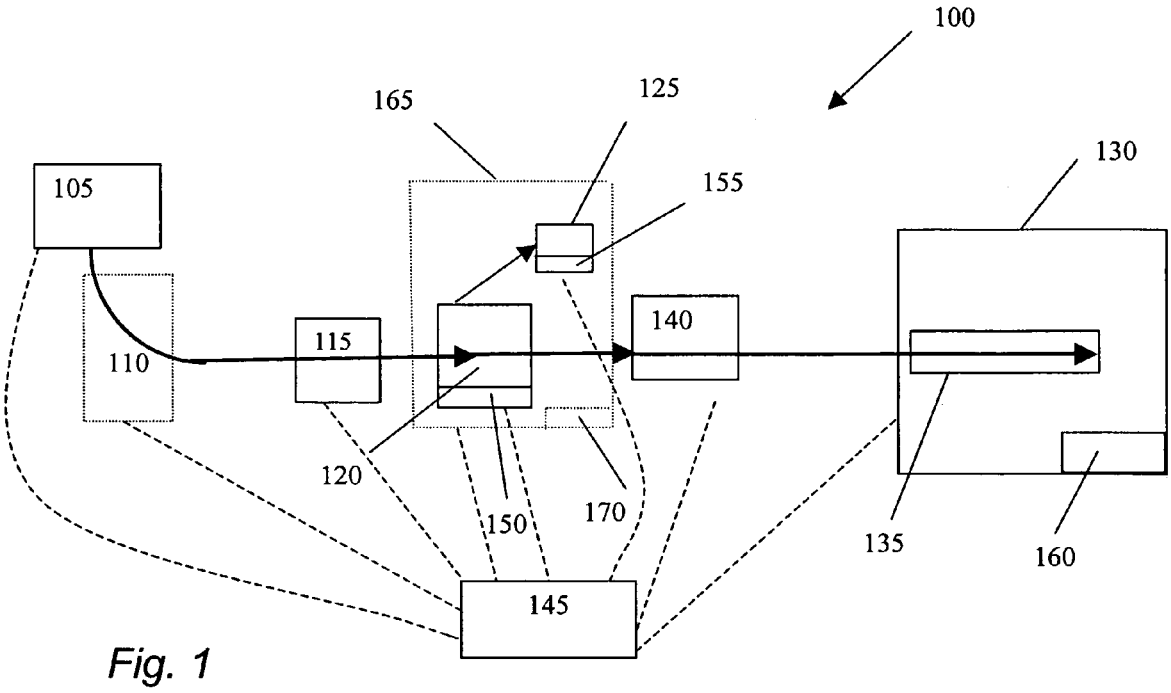
FIG. 1 is a schematic illustration of an apparatus implementing a method for controlling ion populations in a mass analyzer according to one aspect of the invention.

As illustrated in FIG. 1, an apparatus/system 100 that can be used to control ion populations in a mass analyzer 130 according to one aspect of the invention includes an ion source 115 in communication with an ion accumulator 120 (with associated ion accumulator electronics 150), a detector 125 (with associated detector electronics 155), and a mass analyzer 130. Some or all of the components of system 100 can be coupled to a system control unit, such as an appropriately programmed digital computer 145, which receives and processes data from the various components and which can be configured to perform analysis on data received.

Ion source 115, which can be any conventional ion source such as an ion spray or electrospray ion source, generates ions from material received from, for example, an autosampler 105 and a liquid chromatograph 110. Ions generated by ion source 115 proceed (directly or indirectly) to ion accumulator 120. Ion accumulator 120 functions to accumulate ions derived from the ions generated by ion source 115. As used in this specification, ions "derived from" ions provided by a source of ions include the ions generated by source of ions as well as ions generated by manipulation of those ions as will be discussed in more detail below. The ion accumulator 120 can be, for example, in the form of a multipole ion guide, such as an RF quadrupole ion trap or a RF linear multipole ion trap, or a RF "ion tunnel" comprising a plurality of electrodes configured to store ions and having apertures through which ions are transmitted. Where ion accumulator 120 is an RF quadrupole ion trap, the range and efficiency of ion mass to charge (m/z's) captured in the RF quadrupole ion trap may be controlled by, for example, selecting the RF and DC voltages used to generate the quadrupole field, or applying supplementary fields, e.g. broadband waveforms. A collision or damping gas preferably can be introduced into the ion accumulator in order to enable efficient collisional stabilization of the ions injected into the ion accumulator 120.

In the implementation illustrated in FIG. 1, ion accumulator 120 can be configured to eject ions towards detector 125, which detects the ejected ions. Detector 125 can be any conventional detector that can be used to detect ions ejected from ion accumulator 120. In one implementation, detector 125 can be an external detector, such as an electron multiplier detector or an analog electrometer, and ions can be ejected from ion accumulator 120 in a direction transverse to the path of the ion beam towards the mass analyzer.

Ion accumulator 120 can also be configured to eject ions towards mass analyzer 130 (optionally passing through ion transfer optics 140) where the ions can be analyzed, for example, in analysis portion (e.g., cell) 135. The mass analyzer 130 can be any conventional trapping-type ion mass spectrometer, such as a three-dimensional quadrupole ion trap, an RF linear quadrupole ion trap mass spectrometer, an orbitrap, an ion cyclotron resonance mass spectrometer, although other conventional mass analyzers, such as time-of-flight mass spectrometers, can be used.

Figure 2:
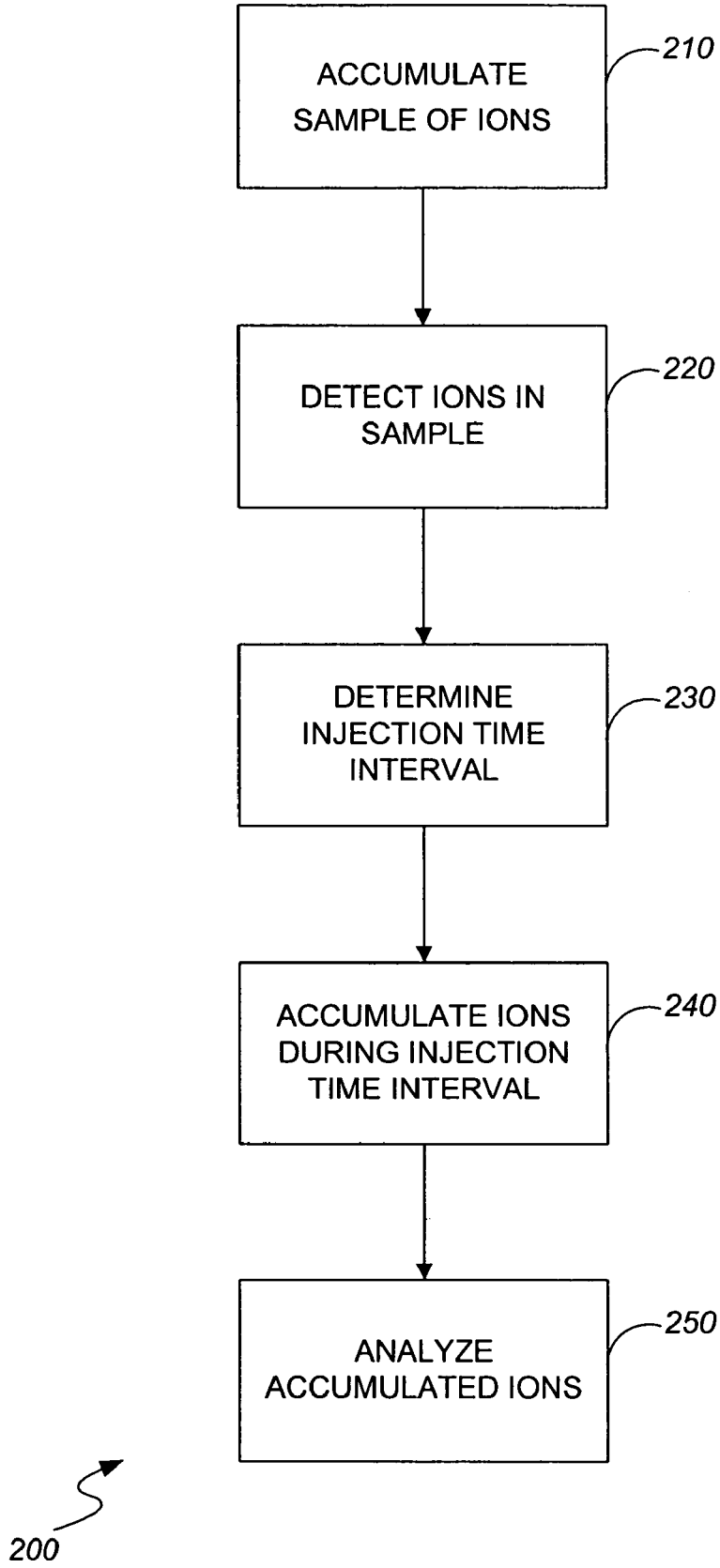
FIG. 2 is a flow diagram illustrating a method of controlling ion populations in a mass analyzer according to one aspect of the invention.

FIG. 2 illustrates a method 200 of controlling ion population in a mass analyzer 130 in a system 100. The method begins with a pre-experiment, during which ions are accumulated in ion accumulator 120 (step 210), and detected in detector 125 (step 220). Ions are generated in ion source 115 as described above. Ions derived from the generated ions are accumulated in ion accumulator 120 over the course of a predetermined sampling interval (e.g., by opening ion accumulator 120 to a stream of ions generated by ion source 115 for a time period corresponding to a predetermined sampling interval). The duration of the sampling interval can depend on the particular ion accumulator in question, and will generally be any relatively short time interval that is sufficient to supply the ion accumulator with enough ions for the subsequent detection and determination steps of the preexperiment. For example, a typical RF multipole linear ion trap will be filled to capacity with ions generated by an electrospray ionization source over a time of 0.02 to 200 ms, or more. Thus, an appropriate sampling time interval for such an accumulator might be in the neighborhood of 0.2 ms. Substantially all the accumulated ions are then ejected from ion accumulator 120 and at least a portion of the ejected ions are passed on to detector 125. Any remaining ions should be ejected from ion accumulator 120 before ions are next accumulated in ion accumulator 120.

The detected ejected ion signal generated by detector 125 is used to determine an injection time interval (step 230). The injection time interval represents the amount of accumulation time that will be required to obtain a predetermined population of ions that is expected to be optimum for the purpose of a subsequent experiment, as will be described in more detail below. The injection time interval can be determined from the detected ejected ion signal and the predetermined sampling interval by estimating the ion accumulation rate in the ion accumulator 120—that is, by estimating the ion population trapped in the ion accumulator 120 during the sampling time interval. From this estimated accumulation rate (assuming a substantially continuous flow of ions), one can determine the time for which it will be necessary to inject ions into the ion accumulator 120 in order to ultimately produce the final population of ions that is subsequently analyzed by the mass analyzer 130.

Ions are then accumulated in the ion accumulator 120 for a period of time corresponding to the determined injection time interval (step 240). These accumulated ions are transferred to the mass analyzer 130 for analysis (step 250).

As discussed above, the injection time interval represents the period of time for which ions must be supplied to the ion accumulator 120 such that the accumulator accumulates a desired population of ions (after initial processing or manipulations) to optimize the performance of the ion accumulator or the system 100.

Optimum performance can relate to different criteria, such as avoidance of an excessive space charge, space charge constancy over a number of measurements, adaptation to special characteristics of the mass analyzer, and the like. Thus, for example, for low ion populations in the mass analyzer, it can be difficult to differentiate the detected population of ions from the noise level. Increasing the population of ions in the analysis chamber of the mass analyzer can avoid this problem.

On the other hand, increasing the population of ions in a Fourier transform mass spectrometer too far can lead to space charge problems, causing individual ions to experience a shift in frequency, resulting in deterioration in m/z assignment accuracy. This frequency shift can be a localised frequency shift or a bulk frequency shift, which can lead to errors in m/z assignment. At higher charge levels, peaks close in frequency (m/z) will coalesce either fully or partially. This can be of particular concern when dealing with a population of ions that are close in isotopic mass, and when measuring mass intensities of adjacent ions.

In order to accumulate ions for the determined injection time interval, the ion accumulator 120 may need to be only partially filled or filled more than once. That is, the ion accumulator 120 may be opened to the stream of ions from ion source 115 for a time period less than the time required to fill the ion accumulator 120 to its full capacity. Alternatively, it may be necessary to fill the ion accumulator multiple times in order to accumulate for the determined injection time interval (e.g., if the accumulator cannot accommodate the amount of ions that would be introduced from the ion source 115 during the full injection time interval). In this case, the accumulated ions can be stored elsewhere (as is described in more detail below) until the desired secondary accumulator population is reached.

Thus, an injection time interval is determined from the ion accumulation rate and from the optimum ion filling conditions associated with the system 100. The optimum population may relate to either the charge density, which takes into consideration both the number of charges and the actual charge on each ion, or the ion density, which takes into consideration the number of ions and assumes that the charge associated with every selected ion is the same (and usually one).

The determination of the injection time interval can be simply based on the detected ion charge (integral of detected ion current):

$$T_{injection\text{-}optimal}=\frac{Q_{detected\text{-}optimal}}{Q_{detected\ AGC\text{-}pre\text{-}experiment}}\times T_{injection\text{-}pre\text{-}experiment}$$

where T represents time, and Q represents the ion charge (integral of the detected ion current) detected. Restrictions or limitations imposed by the ion accumulator 120 and the mass analyzer 130 may dictate whether the optimal ion population (i.e., the population of ions that will be accumulated over the course of the injection time interval) corresponds to an optimum population of ions in the ion accumulator 120, or an optimum population of ions in the analysis cell 135 of the mass analyzer 130. By regulating the population of ions in the ion accumulator 120, and/or in the analysis cell 135 in the mass analyzer 130, the system 100 can be tuned to operate at optimum capacity. That is, accumulating ions only for the determined injection time interval results in an ion population that will fill either the ion accumulator 120 or the analysis cell 135 in the mass analyzer 130 to its maximum capacity that will not saturate that device (i.e., that will not result in undesirable space charge effects).

The final population of trapped ions in the analysis cell 135 can be m/z analyzed in a number of known ways. For example, in an FT-ICR method, trapped ions are excited so that their cyclotron motion is enlarged and largely coherent (such that ions of the same m/z have cyclotron motion which is nearly in phase). This radial excitation is generally accomplished by superposing AC voltages onto the electrodes of the analysis cell 135 so that an approximate AC electrostatic dipole field (parallel plate capacitor field) is generated. Once the ions are excited to have large and substantially coherent cyclotron motion, excitation ceases and the ions are allowed to cycle (oscillate) freely at their natural frequencies (mainly cyclotron motion). If the magnetic field is perfectly uniform and the DC electrostatic trapping potential is perfectly quadrupolar (a homogeneous case, with no other fields to consider), then the natural frequencies of the ions are wholly determined by the field parameters and the m/z of the ions. To a good first order approximation in these circumstances, $f=B/(m/ze)$.

The oscillating ions induce image currents in (and corresponding small voltage signals on) the electrodes of the cell. These signals are (with varying degrees of distortion) analog to the motion of the ions in the cell. The signals are amplified, digitally sampled, and recorded. This time domain data, through well known signal processing methods (such as DFT, FFT), are converted to frequency domain data (a frequency spectrum). The amplitude-frequency spectrum is converted to an amplitude-m/z spectrum (mass spectrum) based on a previously determined f to m/z calibration. The intensities of the peaks in the resulting spectrum are scaled by the total time of ion injection (over all "fills" of the ion accumulator) used to provide sample from which the spectrum is generated. Thus the resulting m/z spectrum of the final m/z analysis population of trapped ions in the analysis cell 135 has intensities that are in proportion to the rate at which these ions are produced in the ion source and delivered to the ion accumulator.

System 100 can be adapted to operate in an $MS^n$ mode, in which ions are fragmented (typically following an initial mass selection step), and the fragmented ions are then subjected to mass analysis. As used in this specification, "product ions" includes ions generated with a single mass selection step following by a single fragmentation step (i.e., in an "MS/MS" mode) as well as ions generated with second, third or higher generations of mass selection and fragmentation steps. One technique that can be used to generate product ions is ion fragmentation caused by Collisional Induced Dissociation (CID) of an ion with neutral background gas. Other methods of generating product ions include, but are not limited to, ion-molecule or ion-ion reactions that lead to dissociation, photo-dissociation and thermal dissociation.

Referring again to FIG. 1, one implementation of a system 100 adapted to operate in this mode includes two mass analyzers 165, 130 and associated electronics 170, 160. The first mass analyzer 165 (shown in dotted lines) includes an ion accumulator 120 such as a RF linear quadrupole ion trap, and can be operated to select specific ions and, if desired, to produce product ions over a number of generations. Analyzer 165 can also be used to verify the mass and quantity of the selected ions (i.e., generate a mass spectrum of the ions trapped in the device).

In one mode of operation, ions are injected into an essentially empty RF linear quadrupole ion trap (ion accumulator 120) as described above. The voltages applied to the RF linear quadrupole ion trap are then manipulated to select ions of a specific mass to charge (m/z) or in a specific mass to charge (m/z) range. The efficiency and accuracy of this step are space charge dependent. In an implementation using CID, the parent or precursor ions are trapped in isolation, and these trapped ions are excited in a gaseous medium to cause fragmentation of the isolated ions, and hence produce product ions. The yield of product ions will vary depending upon the success of both isolation and fragmentation.

Substantially all of the product ions are then ejected from the linear ion trap and at least a portion of them are passed on to detector 125, where they are detected as described above. Preferably this is done as a scan where the ions are ejected in m/z sequence. This allows for correction of m/z dependant effects. The detected ejected ion signal is used to regulate the population of ions trapped in the linear ion trap, and in turn, the population of ions transported to, then trapped, and subsequently analyzed in mass analyzer 130.

An injection time interval is determined. In this mode of operation, the desired optimum ion population in the accumulator can correspond to a desired population of product ions entering mass analyzer 130 (which is not necessarily the same as the population of (parent) ions originally entering the ion accumulator). In this case, the injection time interval represents the time that will be required to fill the ion accumulator 120 with a population of parent ions sufficient to yield the desired population of product ions after any selection and fragmentation steps.

Once the appropriate injection time interval has been determined, ions are introduced into and accumulated in the multipole ion guide of the first mass analyzer 165 for a time period corresponding to that interval. The accumulated ions are then transferred through ion transfer optics 140 into the analysis cell 135 of the second mass analyzer 130, where they are analyzed as described above.

Preferably, the ions for use in an MS/MS mode are regulated not in the form of "product ions" but in the form of initial (i.e., parent) ions. The ions are injected into an essentially empty RF linear quadrupole ion trap 120 during a sampling time interval. The precursor ions are then selected in the RF linear quadrupole ion trap. The isolated (precursor) contents are then ejected from the RF quadrupole linear trap 120 and at least a portion of them passed on to a detector 125.

The detected ejected ion signal is used to determine an injection time interval representing the amount of time for which it will be necessary to inject ions into the RF linear quadrupole ion trap 120 in order to ultimately control the population of product ions produced in the RF linear quadrupole ion trap or the final population of product ions that are subsequently analyzed in the mass analyzer 130.

This determination will be based on several assumptions, including the assumption that the yield of product ions resulting from precursor ions will be substantially constant under relatively constant operating conditions. In this instance, controlling the population of ions in the RF linear quadrupole ion trap 120 provides effective control (or at least limitation) of the ion population in the analysis cell 135 of the ICR.

In one implementation for MS/MS operation, system 100 includes a Fourier transform mass spectrometer as the mass analyzer 130, and the first stage of the mass to charge (m/z) selection (the selection of the precursor ion(s)) is performed prior to the introduction of ions to a RF linear quadrupole ion trap (ion accumulator 120). In this case, the final ion population to be introduced into the RF linear quadrupole ion trap (either at one time or over several iterations) is determined by the FTMS ion population limit. The relationship between how "full" the RF linear quadrupole ion trap must be to appropriately fill the analyzing cell 135 of the mass analyzer 130 for the desired FTMS results (that is, the optimum population of selected ions to be introduced into the RF linear quadrupole ion trap in order to ensure the desired ion population in the analysis cell) can be determined empirically, using appropriate pre-experiments.

Alternatively, the first stage of the mass to charge (m/z) selection in an MS/MS mode can be performed in the RF linear quadrupole ion trap 120. In this case, the final population of ions transferred to the FTMS mass analyzer can be controlled based on the population of selected ions, taking into account the proportion of the initial ions expected to be lost in the selection step, the efficiency of the fragmentation step, and the amount of ions that will be required to produce FTMS m/z spectra to within a desired maximum error. Once again, this is an empirically determined calibration based on appropriate pre-experiments.

It should be noted that in most cases the relative capacity of the ICR cell 135 will be about the same or much greater than that of a linear ion trap 120. In any case, the maximum allowable space charge levels in the ICR cell 135 translated back to space charge levels in the linear ion trap 120 prior to ion extraction will depend strongly on the apparatus (magnetic field strength, ICR cell size) and the desired m/z precision and dynamic range (these trade off with variations in trapped ion numbers, ICR radius etc.) to be provided by the FTICR data. For ultra high mass accuracy experiments, the space charge limit of the FTICR may determine the ion filling of the linear ion trap. For experiments where higher dynamic range but less m/z accuracy is desired in the FT data, the isolation space charge limit of the linear ion trap will likely determine the ion filling of the linear ion trap.

The described apparatus, comprising an ion accumulator 120 and/or a first mass analyzer 165, along with a second mass analyzer 130, in conjunction with the described pre-experiment enables one to feed the mass analyzer 130 in an optimum manner, preferably controlling the population of ions trapped in the ion accumulator 120 and in turn controlling the population of ions transported to, then trapped and analyzed in the analysis cell 135 of the mass analyzer 130.

Figure 3:
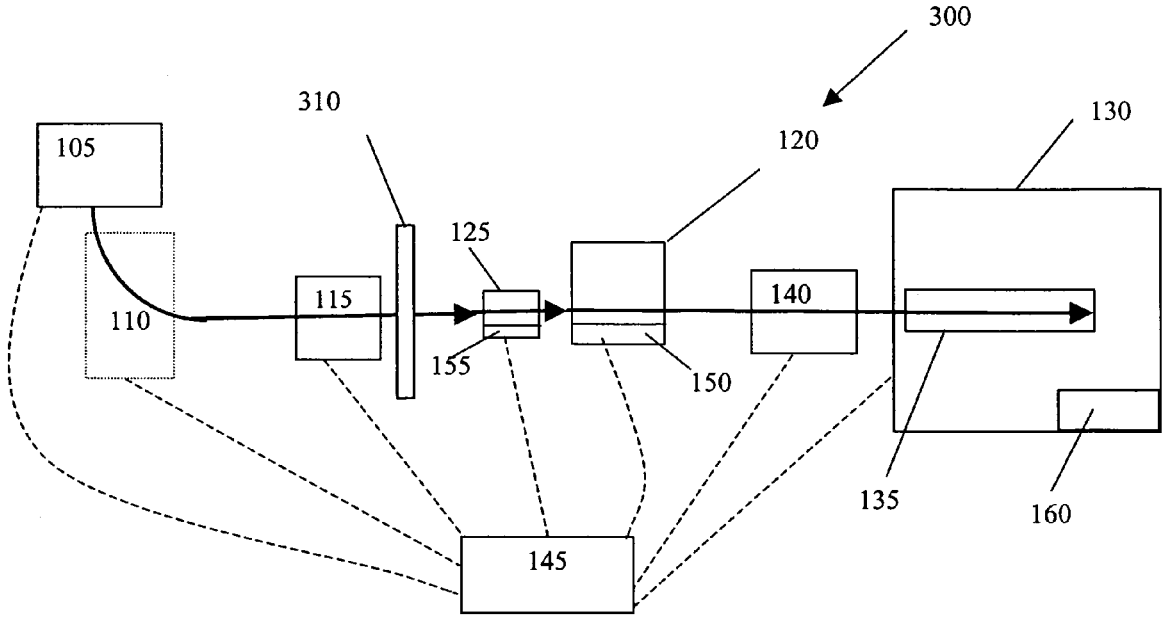
FIG. 3 is a schematic illustration of an alternative implementation of an apparatus according to FIG. 1.

FIG. 3 illustrates an alternative implementation, in which a system 300 includes a detector 125 that is located before the ion accumulator 120. In this implementation, ions generated by the ion source 115 traverse a mass filter 310 before arriving at ion accumulator 120. Mass filter 310 can be any device that is capable of filtering out undesired ions, such that only specific desired ions are passed to ion accumulator 120. Thus, for example, mass filter 310 can be provided by a number of multipoles, for example, quadrupoles, configured to allow only ions of specific m/z ratios, for example, specific product ions, to pass.

In this implementation, the ion accumulator 120 temporarily accumulates ions which may or may not be already pre-selected, and need not have any independent ability to select ions. An example of such an ion accumulator is an RF multipole device. An initial measure of the ion flux is provided by detector 125.

The measured ion flux is used to determine an injection time interval representing how long it will be necessary to inject ions into the ion accumulator 120 in order to ultimately control the final population of ions that is subsequently analyzed in mass analyzer 130.

Ions to be analyzed (or their precursors) are then allowed to pass through the mass filter 310 and are accumulated in the ion accumulator 120. The entire contents of the ion accumulator 120 are sent to mass analyzer 130 for analysis.

Although FIG. 3 shows the detector 125 disposed after the mass filter 310 but before the ion accumulator 20, relative to the beam path, alternative locations for the detector are possible. The detector can be positioned to measure the ion flux of the accumulated ions within the ion accumulator itself.

Figure 4:
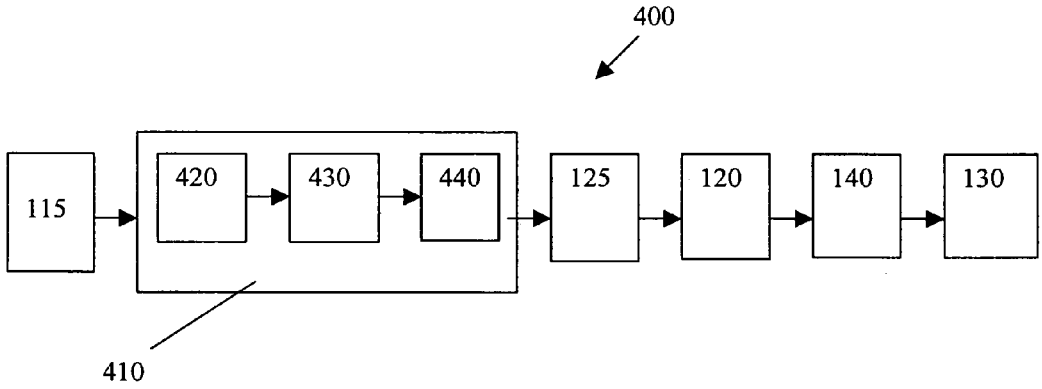
FIG. 4 is a schematic illustration of an implementation of an apparatus according one aspect of the invention, including a triple multipole system, implementing a method for controlling ion populations in a mass analyzer.

FIG. 4 illustrates another variation, in which a system 400 includes a multiple multipole system 410, such as a double or triple quadrupole system, positioned upstream of mass analyzer 130. A conventional configuration for a multiple multipole system 410 includes a quadrupole mass filter 420, a quadrupole collision cell 430, a second quadrupole mass filter 440, followed by a detector 125. The ions are passed from an ion source 115, into the multiple quadrupole system 410, and are then detected by the detector 125.

In conventional operation modes, the triple quadrupole mass spectrometer shown in FIG. 4 performs a substantially similar function to the mass filter 310 illustrated in FIG. 3. Thus, the first quadrupole mass filter 420 is operated such that ions of substantially all mass to charges (m/z) are passed through. The parameters of the quadrupole collision cell 430 (energy of the ions, pressure, electric fields) are set such that no ion fragmentation occurs. The ions passed through the second quadrupole mass filter 440 may be scanned, so that the ions that are passed to the detector 125 result in a mass spectrum. The ions that subsequently pass through the second quadrupole mass filter and are not passed to the detector are accumulated in an ion accumulator 120.

The configuration of FIG. 4 also allows for MS/MS operation ($MS^2$). In this mode, the mass of interest (parent ion) is selected in the first quadrupole mass filter 420. Fragments (product ions) are produced in the quadrupole collision cell 430, are scanned in the second quadrupole mass filter 440 and are then detected by detector 125 or passed through to the ion accumulator 120.

Yet another mode of operation is available if a precursor scan is utilized. In this mode of operation the second quadrupole mass filter 440 is set to a specific mass and scanning is carried out in the first quadrupole mass filter 420.

In another variant of the system illustrated in FIG. 4, the mass filter 440 of the conventional multipole quadrupole mass spectrometer (410) can be replaced by an ion accumulator 120. In this configuration, no additional ion accumulators 120 are required external to the triple quadrupole arrangement. In a first mode of operation in this arrangement, during the sampling time interval ions of substantially all mass to charges (m/z) of an initial sample population are passed through the first quadrupole mass filter 420. The parameters of the quadrupole collision cell 430 are set such that no fragmentation occurs and the ions pass into the ion accumulator 120 and are subsequently detected. The detected signal can be used to estimate the initial ion population that is accumulated in the ion accumulator 120 during the sampling time interval. The injection time interval can then be determined as described above.

In a second mode of operation, the first quadrupole mass filter 420 is used to select precursor ions, selecting a specific m/z or a range of m/z to be passed to the quadrupole collision cell 430. The parameters of the quadrupole collision cell are set such that fragmentation occurs and the resulting ions are accumulated in the ion accumulator 120. The ion accumulator 120 will then transfer them to mass analyzer 130.

In another variant of the system illustrated in FIG, 4, the ion accumulator 120 and the mass analyzer 130 are included in one device, and no ion transfer optics 140 is required. Alternatively, the second mass filter 440 can take the form of an ion storage device, in which case no separate devices 120, 140 and 130 are required.

Figure 5A:
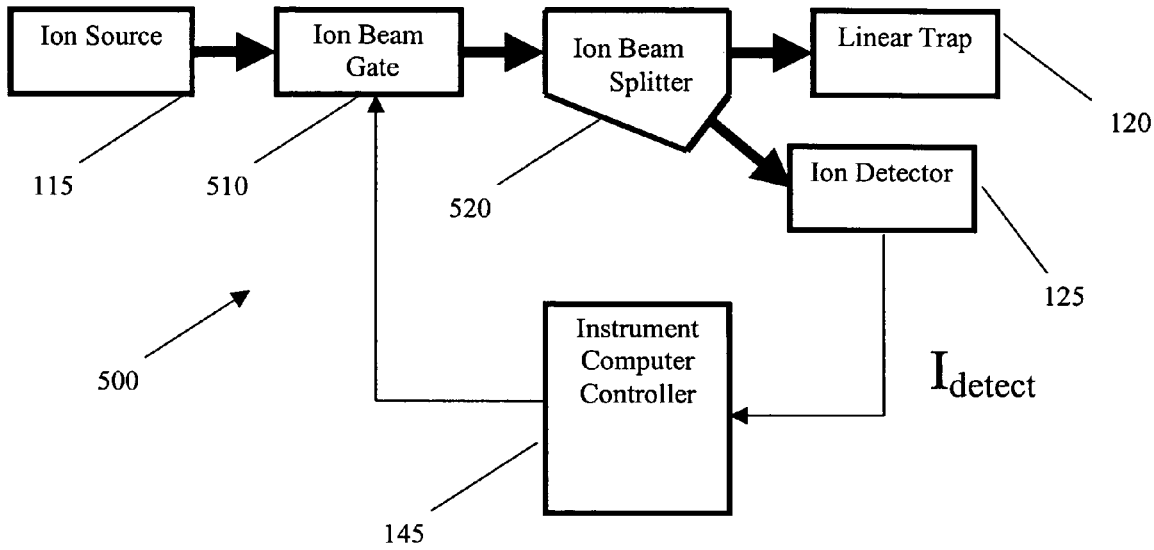
FIG. 5A is a schematic illustration of an alternative implementation of an apparatus according to FIG. 4, incorporating an ion splitter.
Figure 5B:
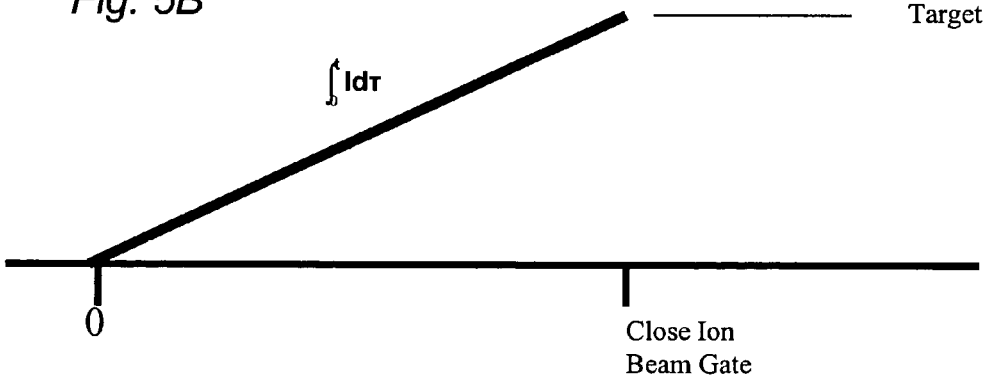
FIG. 5B is a plot illustrating the operation of the apparatus shown in FIG. 5A.

Another variation is illustrated in FIG. 5A, in which the filling of an ion accumulator of a system 500 is monitored in real time, as the ion accumulator is filled. In this variation, an ion beam exiting ion source 115/ion beam gate 510 is split in an ion splitter 520 such that a portion of the ion beam directed to ion accumulator (e.g., linear trap) 120 and a portion is deflected to detector 125. The integrated detector signal is continuously monitored from the time the ion beam is gated on (i.e., from the time injection of ions into the ion accumulator is commenced). When the integrated detected ion current signal reaches a target amount corresponding to the target level of filling of the ion accumulator, the ion beam is gated off, as illustrated in FIG. 5B. Because the accumulation of ions in the ion accumulator is monitored as the device is being filled, no pre-experiment is required in this variation.

An alternative to this embodiment combines the ion beam gate 510, the ion beam splitter 520 and the ion detector 125 into one beam splitting device, such as an aperture lens plate. The ion beam from the ion source is directed towards the beam splitting device. The voltage applied to the aperture lens is controlled to regulate the portion of the ion beam that passes through the aperture of the lens plate to the ion accumulator 120. The remaining portion of the ion beam does not pass through the aperture, but collides with the lens plate itself. Detection of the ion current signal imparted by this portion of the ion beam provides a continuous measurement of the ion current. As described previously, when the integrated detected ion current signal reaches a target amount corresponding to the target level of filling the ion accumulator, the ion beam is gated off, as illustrated in FIG. 5B.

Figure 6A:
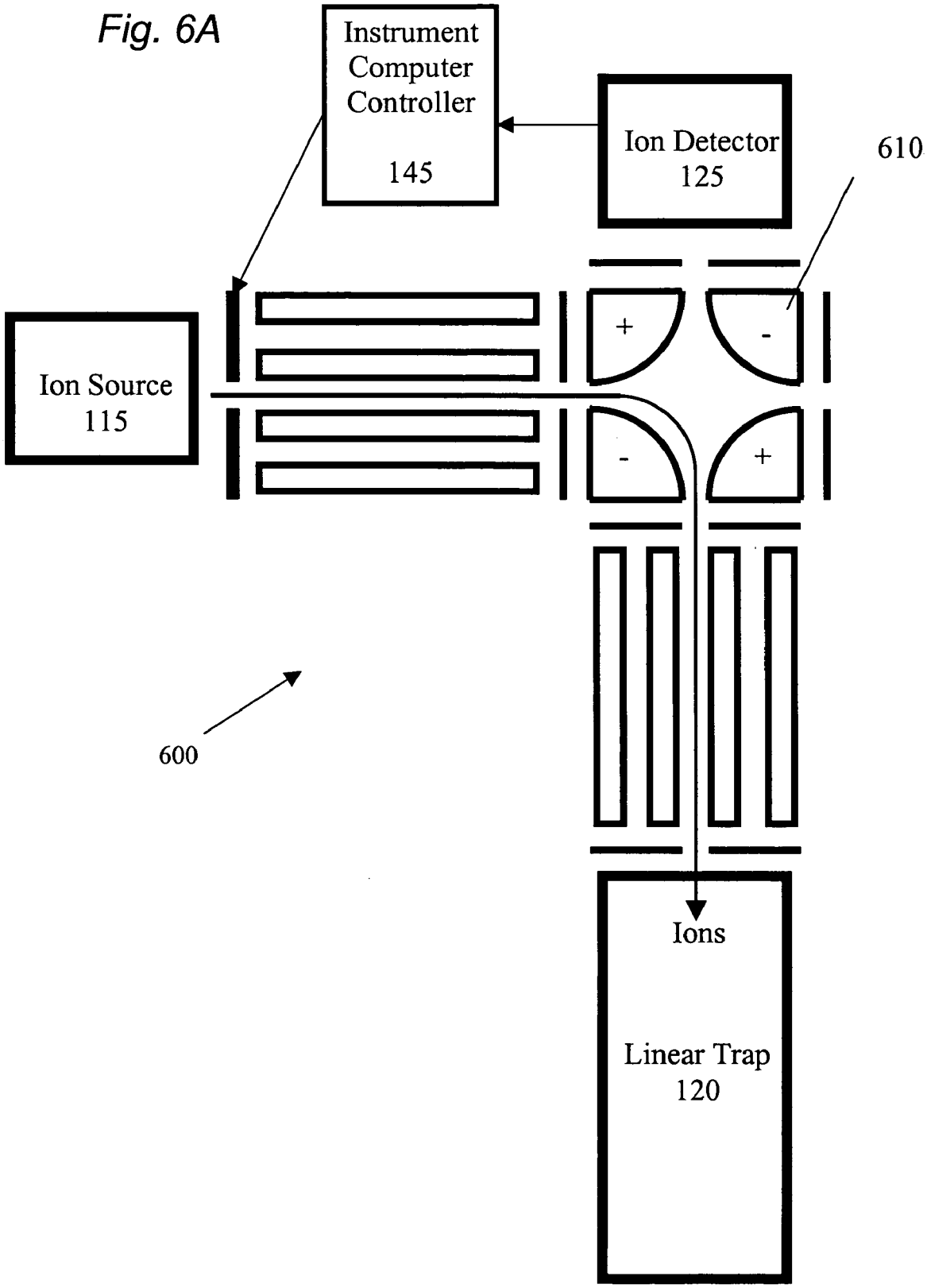
FIGS. 6A and 6B are schematic illustrations of an alternative implementation of an apparatus according to FIG. 4, incorporating a beam switching device.
Figure 6B:
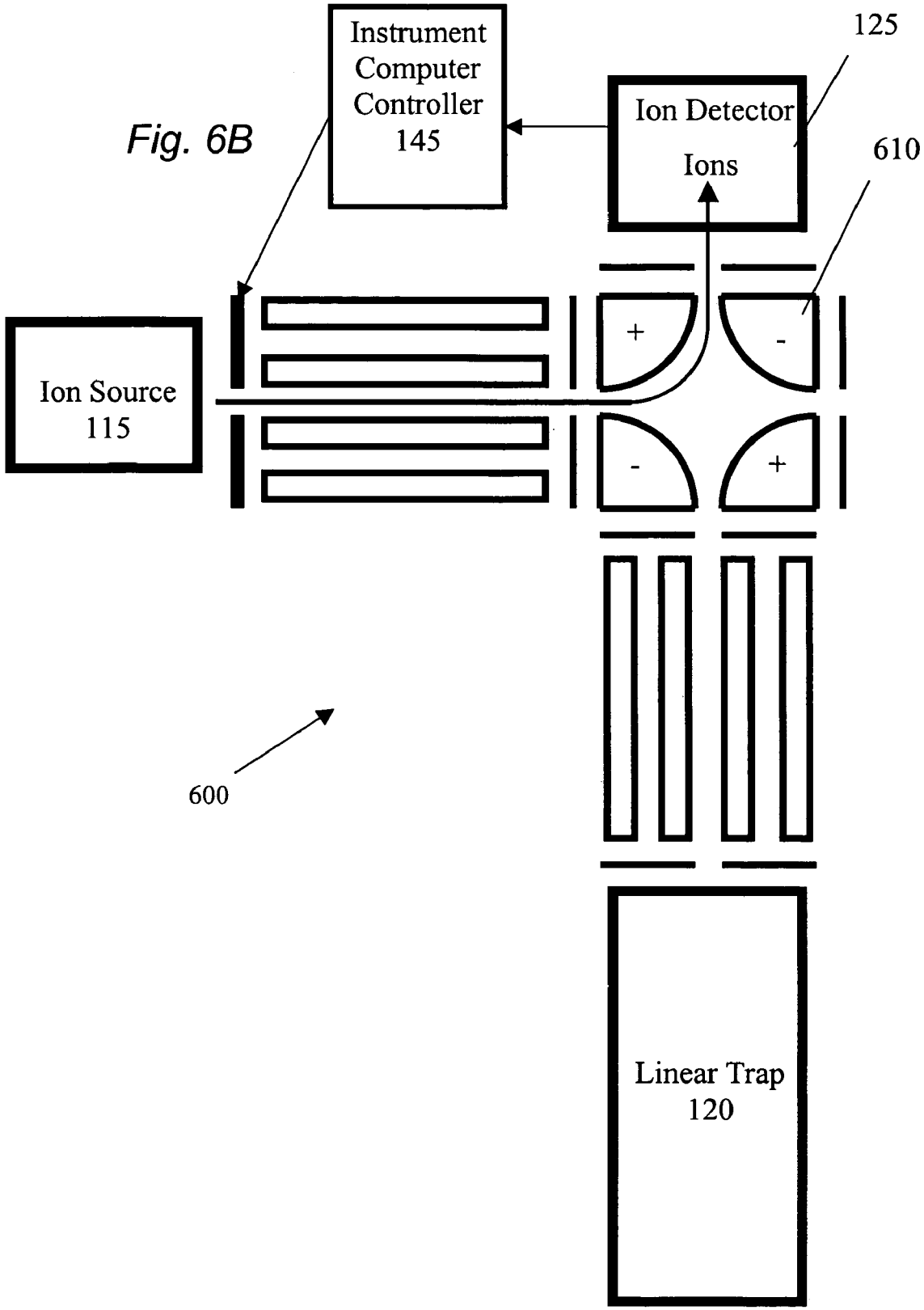

In a particular implementation of the apparatus of FIG. 5A, illustrated in FIGS. 6A–6B, a system 600 incorporates a beam switching device 610, which directs the ion beam to ion accumulator 120 for a predetermined period of time, as illustrated in FIG. 6A, and then directs the ion beam to detector 125 for an additional period of time, as shown in FIG. 6B. Thus, for example, switching device 610 can be operated (e.g., under the control of computer 145) to direct the beam to ion accumulator 120 for 50–90% of a predetermined period, and to detector 125 for the remaining 10–50% of the time period. In one implementation, system 600 is operated such that the ion beam flux is low enough that the fill time of ion accumulator 120 is long compared to the switching cycle time (e.g., more than 2–3 switch cycles). In the implementation illustrated in FIGS. 6A and 6B, beam switching device is shown as a DC quadrupole beam switch, although other switching devices, such as deflection plates, could also be used.

Figure 7:
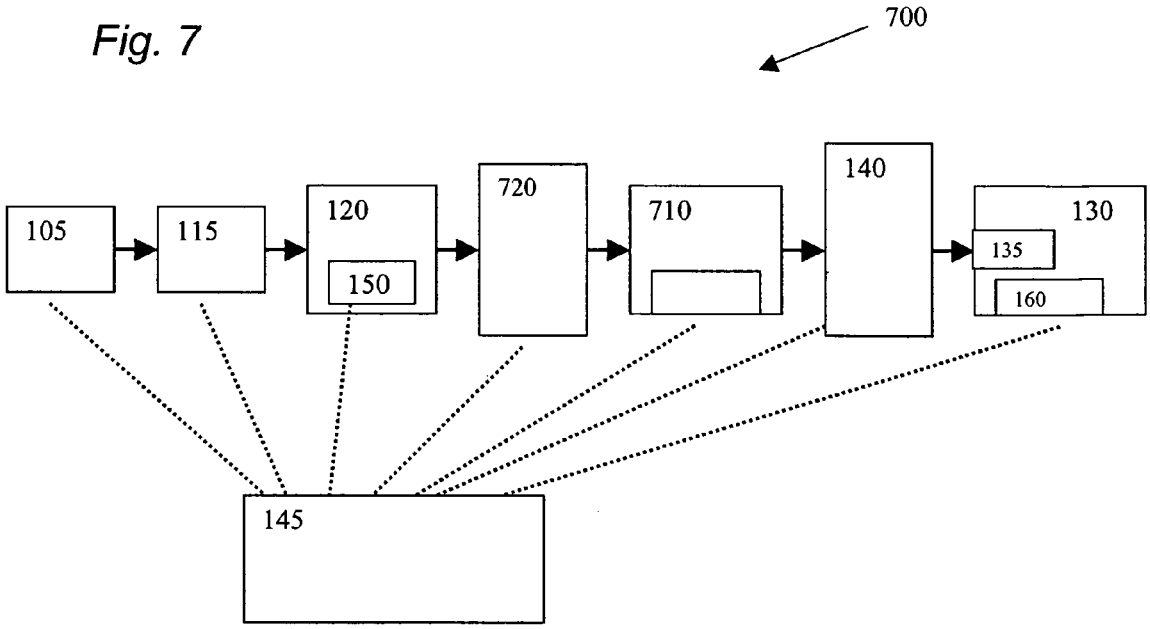
FIG. 7 is a schematic illustration of an alternative implementation of an apparatus according to FIG. 1, incorporating an intermediate ion trap.

FIG. 7 illustrates still another variation, in which a system 700 includes a storage device 710 that has a larger capacity for storing ions than the ion accumulator 120 and that is located after the ion accumulator 120 in the ion beam. In this configuration, the pre-experiment is carried out to determine an injection time interval as described above. If the injection time interval determined for the optimum filling of the mass analyzer 130 would give a population of ions that exceeds the capacity of the ion accumulator 120, only a fraction of the desired ion population is collected in the ion accumulator 120 and is transferred to the larger-capacity intermediate storage device 710. This process is repeated until the total accumulation time corresponds to the determined injection time interval, at which time the storage device 710 contains a final ion population which corresponds to the ion population that will produce the optimum population in the mass analyser after transfer thereto. This ion population is then transferred to mass analyzer 130 for analysis. In one implementation, the storage device 710 is an RF multipole based on a higher order multipole RF field, such as a hexapole or octopole trap.

The storage device 710 can also serve as a collision cell, such that ions enter the device at sufficient kinetic energies that upon collision with an appropriate background gas molecules/atoms (argon, nitrogen, xenon, etc.), collisionally activated decomposition occurs. The system 700 can include ion transfer optics 720 in addition to ion transfer optics 140 (and optionally further ion optics as well), which can be multipoles.

Thus, in the operation of system 700 a population of ions corresponding to the determined injection time interval is collected in the intermediate ion trap 710, and is then transferred in a single step to mass analyzer 130. The total charge of ions deposited to the storage device 710 should not exceed the amount of charge that, when finally transported (after any losses in transport or capture) to the analysis cell 135 will allow the manipulations and m/z analysis of the ions in the analysis cell 135 to work as desired (i.e. m/z accuracy, m/z resolution, isolation width, dynamic range, etc.).

This allows for the collection of the appropriate quantity of ions in a suitable storage device external to the mass analyzer 130. This can be advantageous where the time to perform an analysis scan exceeds the time to carry out a single or multiple fills of the ion accumulator 120. In this case, while the mass analyzer 130 is carrying out its analysis scan, the next population of ions to be analyzed can be accumulated in the storage device external to the mass analyzer 130, and can be ready for analysis as soon as the previous scan has been completed. This increases the duty cycle for such experimentation.

The system 700 can include a collision cell/ion guide between the ion accumulator 120 and the storage device 710, in which extracted ions are collisionally dissociated. These dissociated product ions are then trapped and accumulated in the storage device 710. As discussed above, a collision or damping gas can be introduced into the storage device 710 in order to enable efficient collisional stabilization of ions injected into the device.

The storage device 710 can be optimized for the extraction of ions to optimize their transport to and capture in the analysis cell 135 of the mass analyzer 130. Such a storage device 710 can be designed to provide for the imposition of a DC gradient along the axis of the device during the extraction, which, if implemented in the ion accumulator 120, might necessitate mechanical features that would compromise the ability of the accumulator to perform m/z isolations and m/z scanning.

The charge capacity of the storage device 710 should be sufficiently large (when performing the functions of ion capture, trapping, and extraction) so as not to be a limiting factor.

Figure 8:
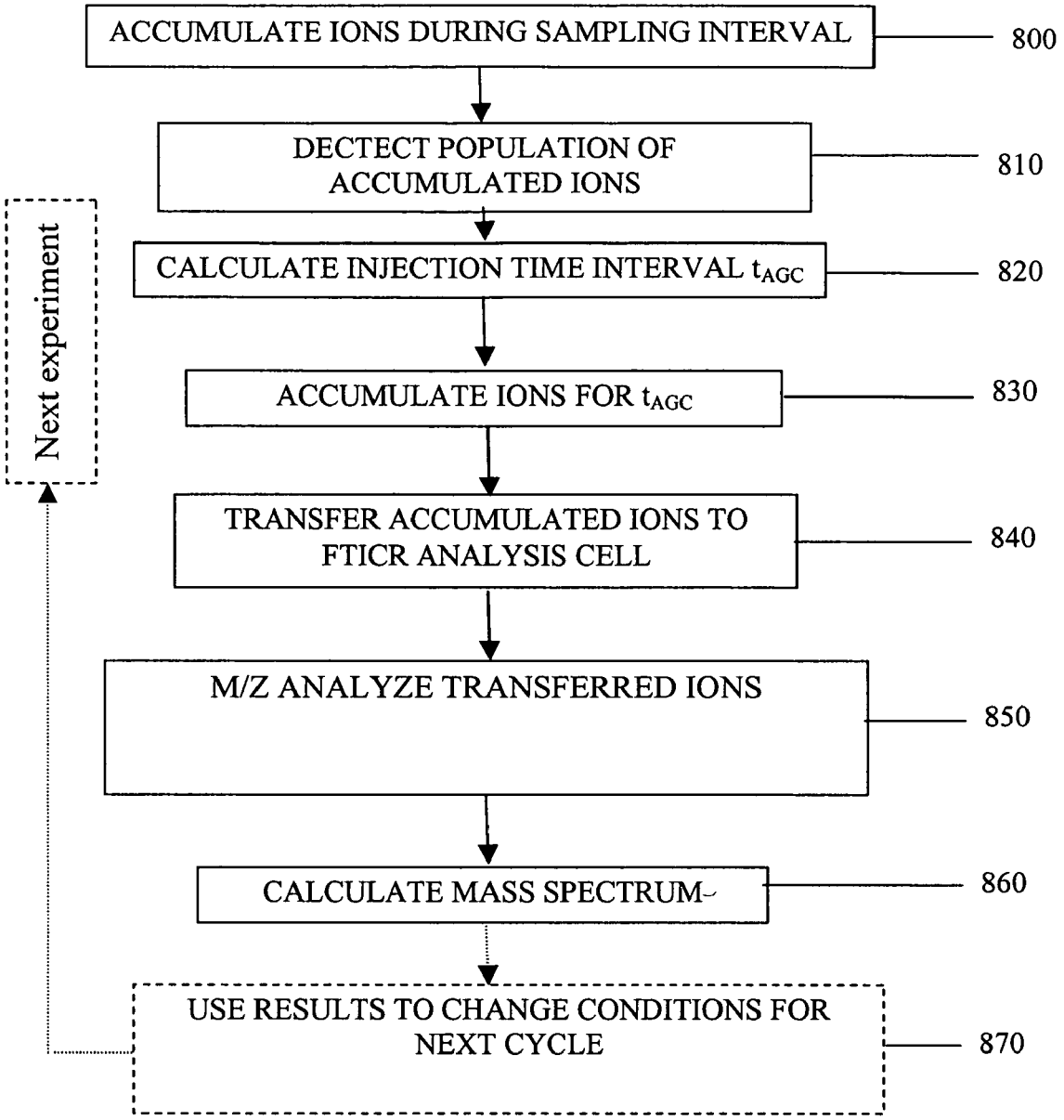
FIG. 8 is a flow diagram illustrating an implementation of a method according FIG. 2 employing a system including a multiple quadrupole and an FTICR.

FIG. 8 illustrates one implementation of a method according to FIG. 2 using a system 100 as shown in FIG. 1, in which the ion accumulator 120 is a RF linear quadrupole ion trap, and the mass analyzer 130 is a Fourier Transform Ion Cyclotron Resonance Mass Spectrometer.

In the method, ions are produced continuously from a source of ions, such as an electrospray ion source as described above. These ions may have been manipulated, modified, filtered, or otherwise interfered with from the time the ions emanate from the original source to the time they enter the RF linear quadrupole ion trap accumulation device 120. During an initial calibration experiment (a pre-experiment), the RF linear quadrupole ion trap 120 is opened and ions are accumulated for a predetermined sampling time interval ($t_{ref}$)—for example for about 0.2 ms (step 800). The predetermined sampling time will vary from pre-experiment to pre-experiment and depending upon the desired results.

The population of trapped ions (the number of distinct ions or a specific charge density) in the ion trap 120 is detected using the detector 125 (step 810).

This information is used to calculate the injection time interval (also referred to as $t_{AGC}$) (step 820), representing the accumulation time necessary to result in a population of ions transferred to the mass analyzer that will produce the best possible measurement results.

After the pre-experiment (i.e., after the injection time interval has been determined), the ions in the ion trap 120 can be quenched to ensure that all the initial sample of ions is removed from the ion accumulator before the introduction of ions to be analyzed in the subsequent experiment. The quenching step can be omitted if quenching is not desired, or if as part of (or as a consequence of) the initial measurement technique, quenching has already been achieved.

Next, the ion trap 120 is opened for a time equal to the injection time interval and a second population of ions of interest is collected (step 830). The ions collected during this injection time interval are transferred to the analysis cell 135 of the FTICR mass spectrometer 130 (step 840). Any product ions that are derived from the collected ions can also be transferred together with (or instead of) the ions that were introduced into the ion accumulator.

The transferred ions are m/z analyzed in the FTICR analyzing mass spectrometer 130 (step 850). Once again, subsequent quenching (not shown) of the previously analyzed ions may be required to ensure that all the "old" ions are removed from the ICR cell prior to the next analysis.

The mass spectrum is determined on the basis of the final analysis results (step 860). Optionally, feedback can be provided before the next sample of ions is introduced into the ion trap 120 (step 870). This feedback can provide useful information to enable optimization of a final analysis step (or scan) or optimization of a subsequent pre-experiment step.

Figure 9:
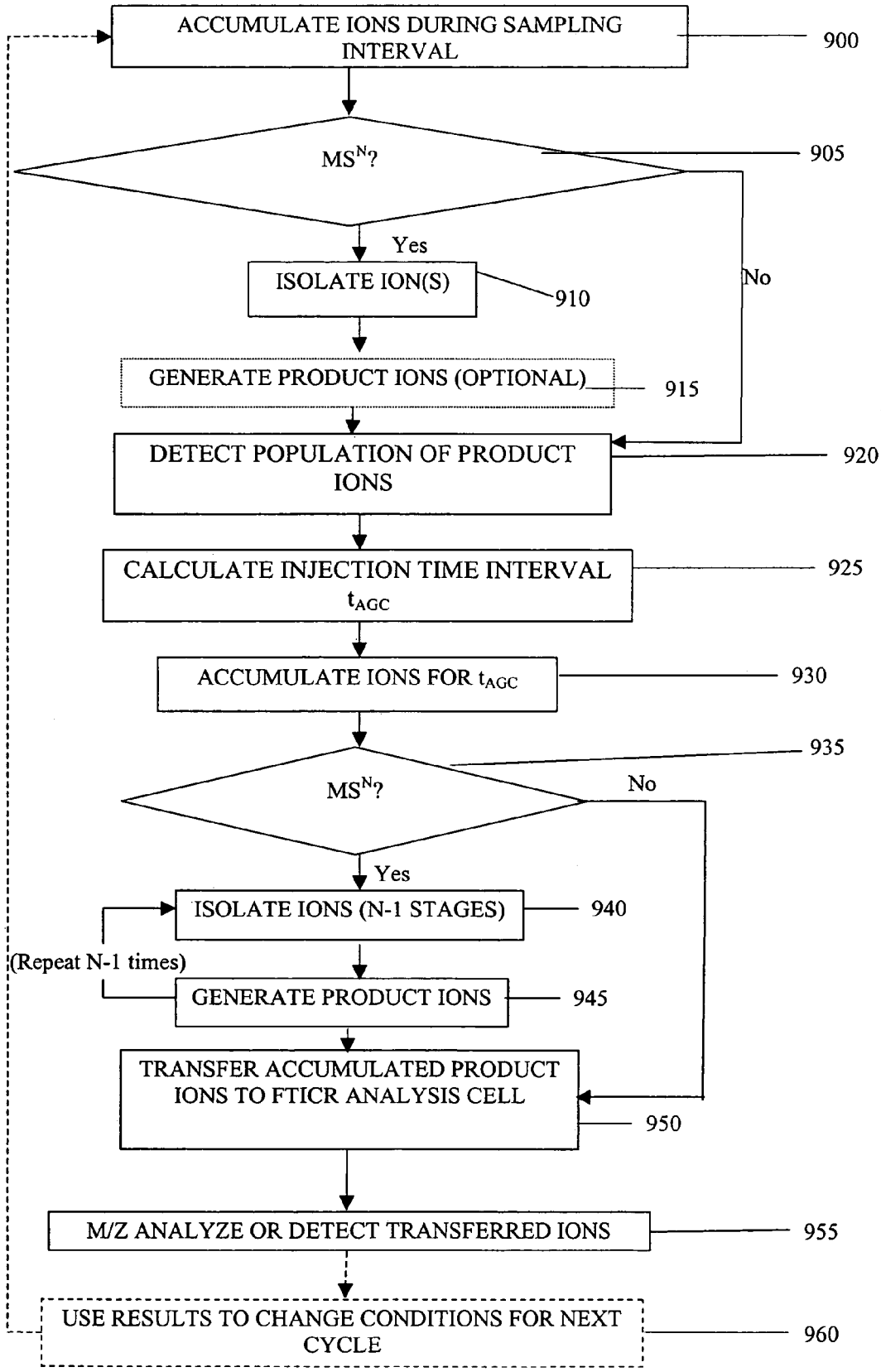
FIG. 9 is a flow diagram illustrating an implementation of a method according FIG. 2, employing a system configured to operate in $MS^n$ mode.

FIG. 9 illustrates one implementation of a method according to FIG. 2 in which the system 100 can be configured to operate in an $MS^n$ mode as discussed above. Ions are collected in the RF quadrupole linear ion trap 120 which is part of the first mass analyzer 165 (step 900). If the operation requires that an $MS^n$ operation be carried out (the "YES" branch of step 905), the linear trap is manipulated to select or isolate a specific mass of interest (parent ion) (step 910). Optionally, the isolated ions are fragmented to generate product ions (step 915). The isolation and fragmentation steps can be performed using a variety of conventional techniques.

The isolated precursor ion population is then detected (step 920) by extracting the precursor ions to a detector. An injection time interval $t_{AGC}$ is determined from the pre-experiment sampling time interval and the detected product ion signal (step 925). Ions are then collected in the RF linear quadrupole ion trap 120 of the first mass analyzer 165 for a period of time corresponding to the injection time interval to attain the optimum product ion population (step 930).

The accumulated ion population is subjected to n−1 successive pairs of isolation (step 940) and fragmentation (step 945) steps. When no further fragmentation is desired (i.e., when the desired generation of product ions has been produced), the accumulated product ions are transferred from the linear ion trap 120 in the first mass analyzer 165 to the analysis cell 135 in the FTICR analyzing mass spectrometer 130 (step 950), where a spectrum analysis is performed (step 955), and the resulting data evaluated and stored, in preparation for the next analysis cycle.

Once product ions have been formed from the parent ions, the isolation and fragmentation steps can be repeated to obtain a next generation of product ions. Depending upon which product ions are required, it may be necessary to repeat steps 940 and 945 until the desired population of product ions is obtained.

The method of FIG. 9 controls the population of a first stage of precursor ions that are isolated. However, as discussed earlier, if the conversion of precursor ions to product ions is efficient, then during the pre-experiment the direct measurement of the parent ion population after isolation provides a good approximation of the product ion population. This allows for the excitation step to be skipped during the pre-experiment, and consequently results in a reduced analysis time. In this case, it is essentially the population of parent or precursor ions in the ion accumulator, and not the population of product ions in the mass analyzer, that is being controlled (although these could ultimately be the same). It is also possible to control the population of ions introduced into the ion accumulator, based on the assumption that a substantially constant proportion of these ions are parent ions of the desired product ions. Thus, the control techniques described herein can be applied at various stages of this and the other processes described herein.

Optionally, the ion population can be controlled at two or more stages in the process. For example, in a $MS^n$ experiment where n>2, each successive isolation-fragmentation iteration will typically result in a substantial reduction of the charge level present in the ion trap. If the space charge capacity of the analysis cell substantially exceeds the space charge of the ions retained in the ion accumulator after the first n−1 cycles of isolation, fragmentation and extraction are complete (which will typically be the case for implementations where the ion accumulator is a linear ion trap and the mass analyzer is an ICR mass spectrometer) it may be desirable to accumulate ions in the ion accumulator in multiple iterations and store the total accumulated ion population in a storage device before transferring the accumulated ions to the ICR mass spectrometer as discussed above.

However, to optimally control the population of ions ultimately transferred to the mass analyzer, a second pre-experiment may be beneficial to determine the trapped ion charge remaining in the ion accumulator after n−1 stages of isolation and fragmentation (which may be strongly dependent on the particular structure of the ions involved). In the second pre-experiment, the ion accumulator is filled to its isolation space charge limit for the $MS^1$ stage of the experiment, and any further manipulations of the trapped ions required to complete the remaining $MS^{n-1}$ stages of the experiment are performed. The resulting ions are ejected to the detector.

Based on the detector signal and optimum population required in the ICR cell (e.g., an empirically established calibration of the required level of filling of the storage device), the number of ion accumulator fills required to give the desired population in the storage device can be determined.

The methods of the invention can be implemented in digital electronic circuitry, or in computer hardware, firmware, software, or in combinations of them. The methods of the invention can be implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the invention can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random-access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a user, the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The invention has been described in terms of particular embodiments. Other embodiments are within the scope of the following claims. For example, while the ion source 115 was described as comprising an electrospray ionization source (ESI), alternative ion sources include:

APCI (atmospheric pressure chemical ionization),
APPI (atmospheric pressure photo-ionization),
APPCI (atmospheric pressure photo-chemical-ionization),
MALDI (matrix assisted laser desorption ionisation),
AP-MALDI (atmospheric pressure-MALDI),
EI (electron impact ionization),
CI (Chemical Ionization),
FAB (Fast Atom Bombardment), and
SIMS (Secondary Ion Mass Spectrometry).

Once the ions have left the ion source 115, they may traverse various ion guides, ion optical elements, or other ion beam transportation means (not shown) before entering the ion accumulator 120. These ion beam qualification means may have m/z filtering properties and may be used to precondition the beam entering the ion accumulator 120.

The ion transfer optics can include RF multipole guides, tube lenses, "ion tunnels" comprising a plurality of RF electrodes having apertures through which ions are transmitted, and/or aperture plate lenses/differential pumping orifices.

The ions initially trapped in the ion accumulator 120 can be manipulated before detection—for example, undesired ions can be ejected at this point to limit the m/z range of ions or to isolate a specific narrow m/z range to be trapped.

As indicated above, the ions may be manipulated or interfered with in a number of ways. In addition to manipulation in m/z range, the charge states of the ions can be manipulated by means of, for example, ion molecule or ion-ion reactions. Other manipulation methods include, but are not limited to, electromagnetic irradiation of the ions to alter the charge state distribution.

Although the detector 125 in FIG. 1 is shown as being located upstream of the mass analyzer 130, away from the axis of the ions propagating towards the mass analyzer 130, the detector 125 can be positioned elsewhere, for example, coaxial with the ion beam entering the mass analyzer 130, as illustrated in FIG. 3. The detector 125 can also be positioned to accommodate axial ejection of ions in addition to radial ejection of ions from the ion trap; alternatively, the ejected ions can be diverted from their beam path and be detected.

Although it may be desirable to eject substantially the entire contents of the ion accumulator 120 in the pre-experiment detection step, all the ions do not necessarily have to be ejected at the same time. The ions may be ejected dependent on m/z for example, such that correction to the ion current measurement can be made for m/z dependent variations in gain and detection efficiency in the detectors. Alternatively, successive ranges of m/z can be pulsed out to the detector 125, essentially providing a simple mass spectrum.

Various manipulations of, for example, voltages applied to the ion accumulator 120 (or storage device 710) and ion transfer optics 130 can be used to effect improved ion transport to and capture of ions in the analysis cell 135 of the mass analyzer 130.

In the pre-experiment stage, the time to extract ions from the ion accumulator 120 (or storage device 710) may be in the region of 0.1–2 milliseconds or more. This time interval will depend on the device used—for example, if an RF linear quadrupole ion trap is used, it will depend upon the length, presence of axial DC, space charge field with the extraction field, pressure and type of damping/collision gas etc. It will also depend upon the m/z (and the chemical structure) of the ions.

The transit time of the ions from the ion accumulator 120 (or storage device 710) to the analysis cell 135 of the mass analyzer 130 will depend upon a number of factors, including, but not limited to their kinetic energies through the ion guides, the length(s) of the guide(s), and the m/z ratio on the ions. The transit time is typically in the region of 20–2000 microseconds or more. The ions traverse through the analysis cell 135 as an extended ion packet (typically with the low m/z ions concentrated in the front of the packet and the high m/z ones more concentrated in the rear).

The population of ions trapped in the analysis cell 135 is based on the portion of the packet that is within the analysis cell 135 when the trapping potentials are altered to (typically the front trapping potentials are raised) to effect trapping of these ions. Usually the trapping potentials of the analysis cell 135 are set so that ions enter the analysis cell 135 at low kinetic energy (ca. 1 eV) and are reflected by the trapping potential at the "back" end of the cell. Having the ion packet (typically) reflect back upon itself approximately doubles the density of the ion packet inside of the analysis cell 135. The transit time of ions though the analysis cell 135 would typically be on the order of 20–200 microseconds (depending on the ion kinetic energies, cell dimensions and m/z).

It may be desirable to stabilize the ions captured in the analysis cell 135 before carrying out m/z analysis or some further manipulation. This may be accomplished by, for example, manipulating the voltages on the analysis cell 135, utilizing adiabatic cooling, lowering the trapping potentials to allow higher energy ions to leak out, or by collisional cooling.

The steps of the methods illustrated and described above can be performed in a different order and still achieve desirable results. The disclosed materials, methods, and examples are illustrative only and not intended to be limiting. The apparatus illustrated and described can include other components in addition to those explicitly described, which may be required for certain applications. The various features explained on the basis of the various exemplary embodiments can be combined to form further embodiments of the invention

What is claimed is:

1. A method for operating a mass analyzer, the method comprising:

a) introducing a sample of ions along an ion path extending from a source of ions to the mass analyzer;

b) accumulating ions derived from the sample of ions during a sampling time interval;

c) detecting ions derived from the sample of ions;

d) determining an injection time interval based on the detecting and the sampling time interval, the injection time interval representing a time interval for obtaining a predetermined population of ions;

e) accumulating ions for a time corresponding to the injection time interval; and f) introducing ions derived from the accumulated ions into the mass analyzer.

2. The method of claim 1, wherein:

the steps (a) through (f) are performed in the order recited.

3. The method of claim 1, wherein:

the sample of ions and the ions are accumulated in steps (b) and (e) in an ion accumulator.

4. The method of claim 3, further comprising:

g) transferring the accumulated ions from the ion accumulator to a storage device before performing step (f).

5. The method of claim 4, wherein:

accumulating ions for a time corresponding to the injection time interval includes accumulating ions during two or more time periods; and transferring the accumulated ions from the ion accumulator to a storage device includes transferring the accumulated ions from the ion accumulator to the storage device after each of the two or more time periods before performing step (f).

6. The method of claim 5, further comprising:

determining a number of time periods during which ions will be accumulated in step (e); and wherein steps (e) and (g) are performed the determined number of times before performing step (f).

7. The method of claim 6, wherein:

the injection time interval determined in step (d) represents a time interval for obtaining a predetermined optimum population of precursor ions in the ion accumulator.

8. The method of claim 3, wherein:

the ion accumulator includes a multipole ion guide.

9. The method of claim 8, wherein:

the multipole ion guide is a RF multipole linear ion trap.

10. The method of claim 9, wherein:

detecting ions derived from the sample of ions includes ejecting at least a portion of the ions derived from the sample of ions from the ion accumulator to a detector in a direction transverse to an ion path from the ion accumulator to the mass analyzer.

11. The method of claim 8, wherein:

the multipole ion guide is an RF quadrupole ion trap.

12. The method of claim 3, further comprising:

filtering the sample of ions and the ions with a mass filter before accumulating the ions in steps (b) and (e).

13. The method of claim 12, wherein:

filtering the sample of ions and the ions includes passing the sample of ions and the ions through a multipole device including one or more mass filters.

14. The method of claim 12, wherein:

the mass filter includes a quadrupole device.

15. The method of claim 3, wherein:

step (c) is performed after step (b).

16. The method of claim 3, further comprising:

removing substantially all ions from the ion accumulator before accumulating ions in step (e).

17. The method of claim 3, wherein:

accumulating ions includes receiving ions in the ion accumulator substantially continuously during a single time interval.

18. The method of claim 3, wherein:

the ion accumulator includes a mass spectrometer.

19. The method of claim 1, wherein:

detecting ions derived from the sample of ions includes detecting the charge density of the ions derived from the sample of ions.

20. The method of claim 1, wherein:

detecting ions derived from the sample of ions includes detecting the ion density of the ions derived from the sample of ions.

21. The method of claim 1, wherein:

detecting ions derived from the sample of ions includes detecting ions in the sample of ions.

22. The method of claim 21, wherein:

introducing ions derived from the accumulated ions into the mass analyzer includes introducing at least a portion of the accumulated ions into the mass analyzer.

23. The method of claim 21, further comprising:

generating product ions from the ions accumulated in step (d);

wherein introducing ions derived from the accumulated ions includes introducing at least a portion of the product ions into the mass analyzer.

24. The method of claim 1, further comprising:

generating product ions from ions in the sample of ions; and generating product ions from the ions accumulated in step (d); wherein detecting ions derived from the sample of ions includes detecting at least a portion of the product ions generated from ions in the sample of ions; and introducing ions derived from the accumulated ions into the mass analyzer includes introducing into the mass analyzer at least a portion of the product ions generated from the ions accumulated in step (e).

25. The method of claim 1, wherein:

the mass analyzer is an RF quadrupole ion trap mass spectrometer, a ion cyclotron resonance mass spectrometer, or an orbitrap mass spectrometer.

26. The method of claim 1, wherein:

the source of ions produces a substantially continuous stream of ions.

27. The method of claim 1, wherein:

the source of ions is an atmospheric pressure chemical ionization (APCI) source, an atmospheric pressure photo-ionization (APPI) source, an atmospheric pressure photo-chemical-ionization (APPCI) source, a matrix assisted laser desorption ionization (MALDI) source, an atmospheric pressure MALDI(AP-MALDI) source, an electron impact ionization (EI) source, an electrospray ionization (ESI) source, an electron capture ionization source, a fast atom bombardment source or a secondary ions (SIMS) source.

28. The method of claim 1, further comprising:

determining a mass spectrum of the ions derived from the accumulated ions.

29. The method of claim 28, wherein:

determining a mass spectrum includes scaling intensities of peaks in the mass spectrum according to the injection time interval.

30. A method of controlling an ion population to be analyzed in a mass analyzer, the method comprising:

determining an accumulation period representing a time required to accumulate a predetermined population of ions;

accumulating ions for an injection time interval corresponding to the accumulation period; and introducing ions derived from the accumulated ions into the mass analyzer.

31. A method of operating a mass analyzer, the method comprising:

controlling a population of ions to be introduced into the mass analyzer by accumulating ions and introducing ions derived from the accumulated ions into the mass analyzer, the ions being accumulated for a time period determined as a function of an ion accumulation rate and a predetermined population of ions, the accumulation rate representing a flow rate of ions from a source of ions into an ion accumulator.

32. The method of claim 31, wherein:

the accumulation rate is measured while the ions are being accumulated.

33. The method of claim 32, wherein:

the accumulation rate is measured by diverting a portion of an ion beam to a detector while the ions are being accumulated.

34. The method of claim 33, wherein:

diverting a portion of an ion beam includes transmitting a portion of the ion beam to an ion accumulator and detecting a signal representative of a remaining portion of the ion beam while the ions are being accumulated.

35. A method of operating a mass analyzer, the method comprising:

a) introducing a first sample of ions from a source of ions into a multiple multipole device;

b) accumulating in an ion accumulator ions derived from the first sample of ions during a sampling time interval;

c) detecting ions derived from the first sample of ions;

d) determining an injection time interval based on the detecting and the sampling time interval, the injection time interval representing a time interval for obtaining a predetermined population of ions;

e) introducing a second sample of ions from the source of ions into the multiple multipole device;

f) accumulating in the ion accumulator ions derived from the second sample of ions for a time corresponding to the injection time interval; and g) introducing ions derived from the accumulated ions into the mass analyzer.

36. The method of claim 35, further comprising:

generating product ions by fragmenting ions of the second sample of ions in the multiple multipole device;

wherein accumulating ions derived from the second sample of ions includes accumulating at least a portion of the product ions in the ion accumulator.

37. The method of claim 35, wherein:

the ion accumulator is included in the multiple multipole device.

38. A mass analyzing apparatus, comprising:

a source of ions;

a mass analyzer located downstream of the source of ions along an ion path;

an ion accumulator located between the source of ions and the mass analyzer along the ion path;

a detector located to receive ions from the source of ions and configured to generate signals indicative of detecting the received ions; and a programmable processor in communication with the detector and the ion accumulator, the processor being operable to:

use the detector signals to determine an accumulation period representing a time required to accumulate in the ion accumulator a specified population of ions;

cause the ion accumulator to accumulate ions for an injection time interval corresponding to the accumulation period; and introduce ions derived from the accumulated ions into the mass analyzer.

39. The apparatus of claim 38, wherein:

the ion accumulator is included in a second mass analyzer.

40. The apparatus of claim 38, further comprising:

a mass filter located between the source of ions and the ion accumulator along the ion path.

41. The apparatus of claim 40, wherein:

the mass filter is included in a multiple multipole device located downstream of the source of ions along the ion path.

42. The apparatus of claim 41, wherein:

the multiple multipole device includes a mass filter and a collision cell.

43. The apparatus of claim 38, wherein:

the detector is located outside of the ion path; and the ion accumulator is configurable to eject ions linearly along the ion path towards the analyzing mass analyzer or towards the detector in a direction transverse to the ion path.

44. The apparatus of claim 41, further comprising:

a diversion unit located downstream of the multiple multipole device along the ion path, the diversion unit being configurable to divert ions from the ion path towards the detector.

45. The apparatus of claim 38, wherein:

the detector is located along the ion path.

46. The apparatus of claim 45, wherein:

the detector includes a conversion dynode located downstream of the multiple multipole device along the ion path.

47. The apparatus of claim 38, further comprising:

a storage device located downstream of the ion accumulator along the ion path, the storage device being configurable to iteratively receive and accumulate ion samples from the ion accumulator and to eject the accumulated ion samples towards the mass analyzer.

48. The apparatus of claim 38, wherein:

the mass analyzer is an RF quadrupole ion trap mass spectrometer, a ion cyclotron resonance mass spectrometer, or an orbitrap mass spectrometer.

49. The apparatus of claim 38, wherein:

the source of ions is an atmospheric pressure chemical ionization (APCI) source, an atmospheric pressure photo-ionization (APPI) source, an atmospheric pressure photo-chemical-ionization (APPCI) source, a matrix assisted laser desorption ionization (MALDI) source, an atmospheric pressure MALDI(AP-MALDI) source, an electron impact (EI) source, an electrospray ionization (ESI) source, an electron capture ionization source, a fast atom bombardment source or a secondary ions (SIMS) source.

50. A mass analyzing apparatus, comprising:

a source of ions;

an ion cyclotron resonance (ICR) mass spectrometer located downstream of the source of ions along an ion path;

a detector located off of the ion path;

an RF linear quadrupole ion trap located between the source of ions and the ICR mass spectrometer along the ion path, the RF linear quadrupole ion trap being configured to receive ions from the source of ions along the ion path and being configurable to eject ions linearly along the ion path towards the ICR mass spectrometer or towards the detector in a direction transverse to the ion path;

a programmable processor in communication with the detector and the linear ion trap, the processor being operable to:

determine an accumulation period representing a time required to accumulate in the RF linear quadrupole ion trap a specified population of ions;

cause the RF linear quadrupole ion trap to accumulate ions for an injection time interval corresponding to the accumulation period; and introduce at least a portion of the accumulated ions into the ICR mass spectrometer.

51. The apparatus of claim 50, further comprising:

a multipole mass filter and a multipole collision cell located between the source of ions and the linear ion trap along the ion path.

52. The apparatus of claim 51, further comprising:

a storage device located downstream of the linear ion trap along the ion path, the storage device being configurable to iteratively receive and accumulate ion samples from the linear ion trap and to eject the accumulated ion samples towards the ICR mass spectrometer.

53. A computer program product tangibly embodied on an information carrier for operating a mass analyzer, the product comprising instructions operable to cause apparatus including a mass analyzer operably coupled to a programmable processor to:

a) introduce a sample of ions along an ion path extending from a source of ions to the mass analyzer;

b) accumulate ions derived from the sample of ions during a sampling time interval;

c) detect ions derived from the sample of ions;

d) determine an injection time interval based on the detecting and the sampling time interval, the injection time interval representing a time interval for obtaining a predetermined population of ions;

e) accumulate ions for a time corresponding to the injection time interval; and f) introduce ions derived from the accumulated ions into the mass analyzer.

54. The computer program product of claim 53, wherein:

the instructions operable to cause the apparatus to accumulate ions include instructions operable to cause the apparatus to accumulate ions in an ion accumulator.

55. The computer program product of claim 54, further comprising instructions operable to cause apparatus including a mass analyzer operably coupled to a programmable processor to:

g) transfer the accumulated ions from the ion accumulator to a storage device before performing step (f).

56. The computer program product of claim 54, wherein:

the instructions operable to cause the apparatus to accumulate ions for a time corresponding to the injection time interval include instructions operable to cause the apparatus to accumulate ions during two or more time periods; and the instructions operable to cause the apparatus to transfer at least a portion of the accumulated ions from the ion accumulator to a storage device include instructions to cause the apparatus to transfer at least a portion of the accumulated ions from the ion accumulator to the storage device after each of the two or more time periods before performing step (f).

57. The computer program product of claim 56, further comprising instructions operable to cause apparatus including a mass analyzer operably coupled to a programmable processor to:

determine a number of time periods during which ions will be accumulated in step (e); and wherein steps (e) and (g) are performed the determined number of times before performing step (f).

58. The computer program product of claim 57, wherein: the injection time interval determined in step (d) represents a time interval for obtaining a predetermined optimum population of precursor ions in the ion accumulator.

59. The method of claim 54, wherein:

the ion accumulator is a multipole ion guide.

60. The computer program product of claim 59, wherein: the instructions operable to cause the apparatus to detect ions derived from the sample of ions include instructions operable to cause the apparatus to eject the ions derived from the sample of ions from the ion accumulator to a detector in a direction transverse to the ion path.

61. The computer program product of claim 53, further comprising instructions operable to cause the apparatus to: filter the sample of ions and the ions with a mass filter before accumulating the ions in steps (b) and (e).

62. The computer program product of claim 53, wherein: step (c) is performed after step (b).

63. The computer program product of claim 54, further comprising instructions operable to cause the apparatus to: remove substantially all ions from the ion accumulator before accumulating ions in step (e).

64. The computer program product of claim 53, wherein: the instructions operable to cause the apparatus to detect ions derived from the sample of ions include instructions operable to cause the apparatus to detect ions in the sample of ions.

65. The computer program product of claim 64, wherein: the instructions operable to cause the apparatus to introduce ions derived from the accumulated ions into the mass analyzer include instructions operable to cause the apparatus to introduce at least a portion of the accumulated ions into the mass analyzer.

66. The computer program product of claim 64, further comprising instructions operable to cause the apparatus to: generate product ions from the ions accumulated in step (e);

wherein the instructions operable to cause the apparatus to introduce ions derived from the accumulated ions include instructions operable to cause the apparatus to introduce at least a portion of the product ions into the mass analyzer.

67. The computer program product of claim 54, further comprising instructions operable to cause the apparatus to: generate product ions from ions in the sample of ions; and generate product ions from the ions accumulated in step (e); wherein the instructions operable to cause the apparatus to detect ions derived from the sample of ions include instructions operable to cause the apparatus to detect at least a portion of the product ions generated from the ions in the sample of ions; and the instructions operable to cause the apparatus to introduce ions derived from the accumulated ions into the mass analyzer include instructions operable to cause the apparatus to introduce into the mass analyzer at least a portion of the product ions generated from the ions accumulated in step (e).

68. The computer program product of claim 53, further comprising instructions operable to cause the apparatus to: determine a mass spectrum of the ions derived from the accumulated ions.

69. The computer program product of claim 68, wherein: the instructions operable to cause the apparatus to determine a mass spectrum include instructions operable to cause the apparatus to scale intensities of peaks in the mass spectrum according to the injection time interval.

70. A computer program product tangibly embodied on an information carrier for controlling an ion population to be analyzed in a mass analyzer, the product comprising instructions operable to cause apparatus including a mass analyzer operably coupled to a programmable processor to:

determine an accumulation period representing a time required to accumulate a predetermined population of ions;

accumulate ions for an injection time interval corresponding to the accumulation period; and introduce ions derived from the accumulated ions into the mass analyzer.

71. A computer program product tangibly embodied on an information carrier for operating a mass analyzer, the product comprising instructions operable to cause apparatus including a mass analyzer operably coupled to a programmable processor to:

control a population of ions to be introduced into the mass analyzer by accumulating ions and introducing ions derived from the accumulated ions into the mass analyzer, the ions being accumulated for a time period determined as a function of an ion accumulation rate and a predetermined population of ions, the accumulation rate representing a flow rate of ions from a source of ions into an ion accumulator.

72. The computer program product of claim 71, wherein: the accumulation rate is measured while the ions are being accumulated.

73. The computer program product of claim 72, wherein: the accumulation rate is measured by diverting a portion of an ion beam to a detector while the ions are being accumulated.

74. The computer program product of claim 73, wherein: diverting a portion of an ion beam includes transmitting a portion of the ion beam to an ion accumulator and detecting a signal representative of a remaining portion of the ion beam while the ions are being accumulated.

75. A computer program product tangibly embodied on an information carrier for operating an analyzing mass analyzer, the product comprising instructions operable to cause apparatus including a mass analyzer and a programmable processor to:

a) introduce a first sample of ions from a source of ions into a multiple multipole device;

b) accumulate in an ion accumulator ions derived from the first sample of ions during a sampling time interval;

c) detect ions derived from the first sample of ions;

d) determine an injection time interval based on the detecting and the sampling time interval, the injection time interval representing a time interval for obtaining a predetermined population of ions;

e) introduce a second sample of ions from the source of ions into the multiple multipole device;

f) accumulate in the ion accumulator ions derived from the second sample of ions for a time corresponding to the injection time interval; and g) introduce ions derived from the accumulated ions into the analyzing mass analyzer.

76. A mass analyzing apparatus, comprising:

a source of ions;

a mass analyzer located downstream of the source of ions along an ion path;

an ion accumulator located between the source of ions and the mass analyzer along the ion path;

a detector located to receive ions from the source of ions and configured to generate signals indicative of detecting the received ions; and a programmable processor in communication with the detector and the ion accumulator, the processor being operable to control a population of ions to be introduced into the mass analyzer by accumulating ions and introducing ions derived from the accumulated ions into the mass analyzer, the ions being accumulated for a time period determined as a function of an ion accumulation rate and a predetermined optimum population of ions, the accumulation rate representing a flow rate of ions from a source of ions into an ion accumulator.

77. The apparatus of claim 76, wherein:

the processor is operable to measure the accumulation rate while the ions are being accumulated.

78. The apparatus of claim 77, wherein:

the processor is operable to measure the accumulation rate by diverting a portion of an ion beam to a detector while the ions are being accumulated.

79. The apparatus of claim 77, wherein:

diverting a portion of an ion beam includes transmitting a portion of the ion beam to an ion accumulator and detecting a signal representative of a remaining portion of the ion beam while the ions are being accumulated.

* * * * *